US011370224B2

(12) United States Patent
Fukasawa et al.

(10) Patent No.: US 11,370,224 B2
(45) Date of Patent: Jun. 28, 2022

(54) LIQUID STORAGE CONTAINER

(71) Applicant: SEIKO EPSON CORPORATION, Tokyo (JP)

(72) Inventors: Noriyuki Fukasawa, Matsumoto (JP); Taku Ishizawa, Matsumoto (JP); Tadahiro Mizutani, Shiojiri (JP); Mao Otashiro, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/159,644

(22) Filed: Jan. 27, 2021

(65) Prior Publication Data

US 2021/0229453 A1 Jul. 29, 2021

(30) Foreign Application Priority Data

Jan. 28, 2020 (JP) ..... JP2020-011442

(51) Int. Cl.
*B41J 2/175* (2006.01)

(52) U.S. Cl.
CPC ..... *B41J 2/17553* (2013.01); *B41J 2/17503* (2013.01)

(58) Field of Classification Search
CPC .... B41J 2/175; B41J 2/17503; B41J 2/17523; B41J 2/17553
See application file for complete search history.

(56) References Cited

U.S. PATENT DOCUMENTS 5,666,146 A 9/1997 Mochizuki et al.
6,286,946 B1 * 9/2001 Umemura ..... B41J 2/17533 347/86
6,709,093 B2 * 3/2004 Perkins ..... B41J 2/1753 347/86
6,942,325 B2 * 9/2005 Nanjo ..... B41J 2/1754 53/410
7,108,362 B2 * 9/2006 Sasaki ..... B41J 2/17513 347/86
7,488,059 B1 * 2/2009 Holland ..... B41J 2/17513 347/85
8,083,335 B2 * 12/2011 Ishizawa ..... B41J 2/17513 347/85

FOREIGN PATENT DOCUMENTS

JP H05-16377 A 1/1993

* cited by examiner

*Primary Examiner* — Anh T Vo
(74) *Attorney, Agent, or Firm* — Oliff PLC

(57) ABSTRACT

A liquid storage container includes: a housing including a case having a case opening, and a lid that closes the case opening; and a sheet that holds the lid and the case together, the sheet extending over lid exterior faces and case exterior faces and being disposed so as to surround the outer circumference of the housing.

5 Claims, 10 Drawing Sheets

LIQUID STORAGE CONTAINER

The present application is based on, and claims priority from JP Application Serial Number 2020-011442, filed Jan. 28, 2020, the disclosure of which is hereby incorporated by reference herein in its entirety.

BACKGROUND

1. Technical Field

The present disclosure relates to a liquid storage container.

2. Related Art

A known aspect of a liquid storage container is an ink cartridge accommodating an ink bag that stores ink therein. Some ink cartridges have a case for accommodating an ink bag, and a lid that closes an opening in the case. JP-A-5-16377 discloses a technique in which a case and a lid are removably joined together by means of snap-fitting and are joined together with an adhesive label stuck over the case and the lid so as not to be separated from each other.

When the adhesive label is stuck over the case and the lid, the following inconvenience may occur. For example, a tool is required to remove the adhesive label from the case or the lid to separate them, which may damage the case and the lid and, consequently, may lower the recycling rates of the case and the lid. Furthermore, for example, when the ink cartridge is subjected to a high-temperature environment, the adhesive label may more securely stick to the case and the lid, becoming difficult to remove. This may lower the working efficiency in disassembling ink cartridge.

SUMMARY

According to an aspect of the present disclosure, a liquid storage container is provided. The liquid storage container includes: a housing including a case having a case opening, and a lid that closes the case opening; and a sheet that holds the lid and the case together, the sheet extending over lid exterior faces and case exterior faces and being disposed so as to surround the outer circumference of the housing.

DESCRIPTION OF EXEMPLARY EMBODIMENTS

A. Configuration in First Embodiment

Figure 1:
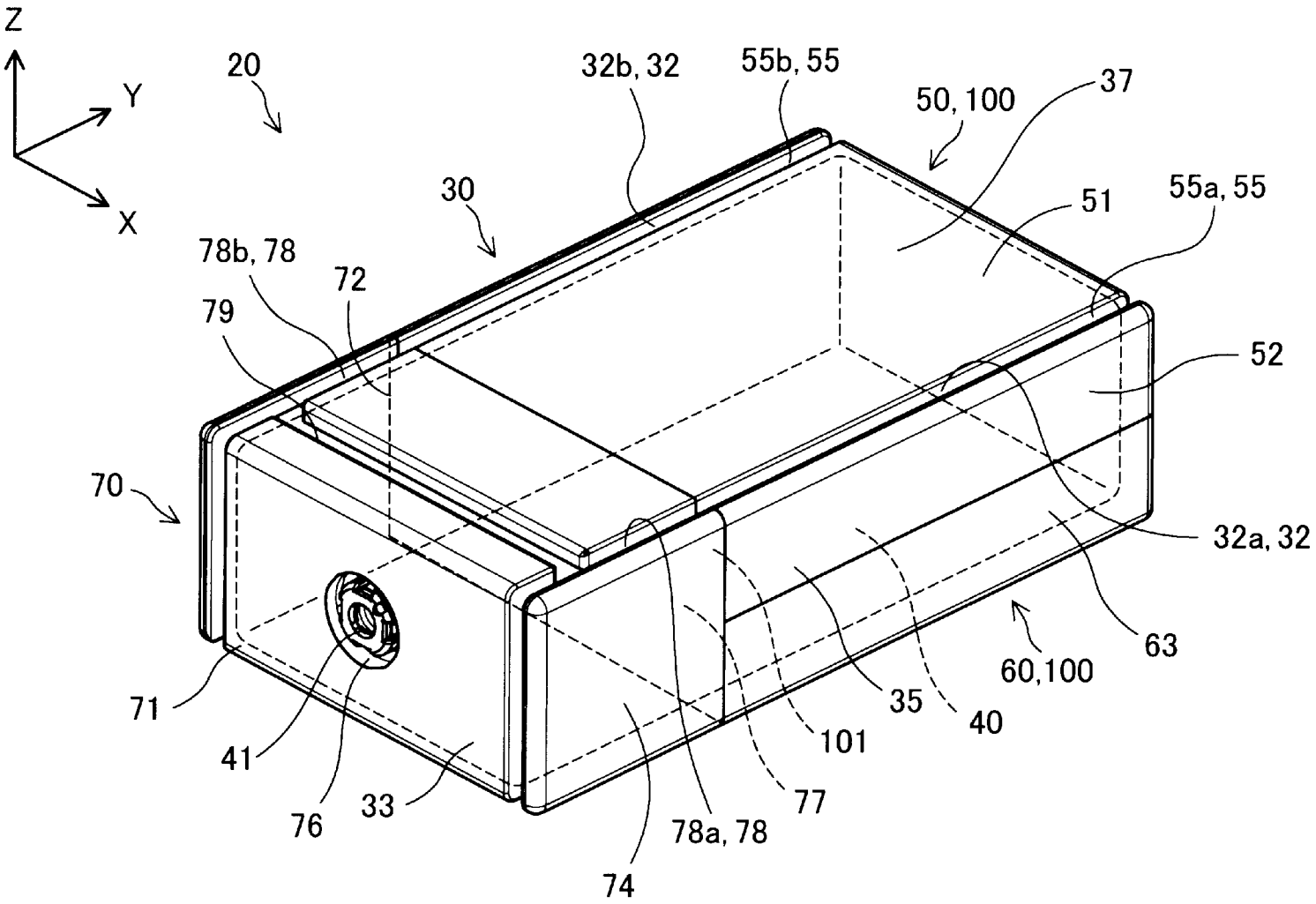
FIG. 1 is a first perspective view of a liquid storage container.
Figure 2:
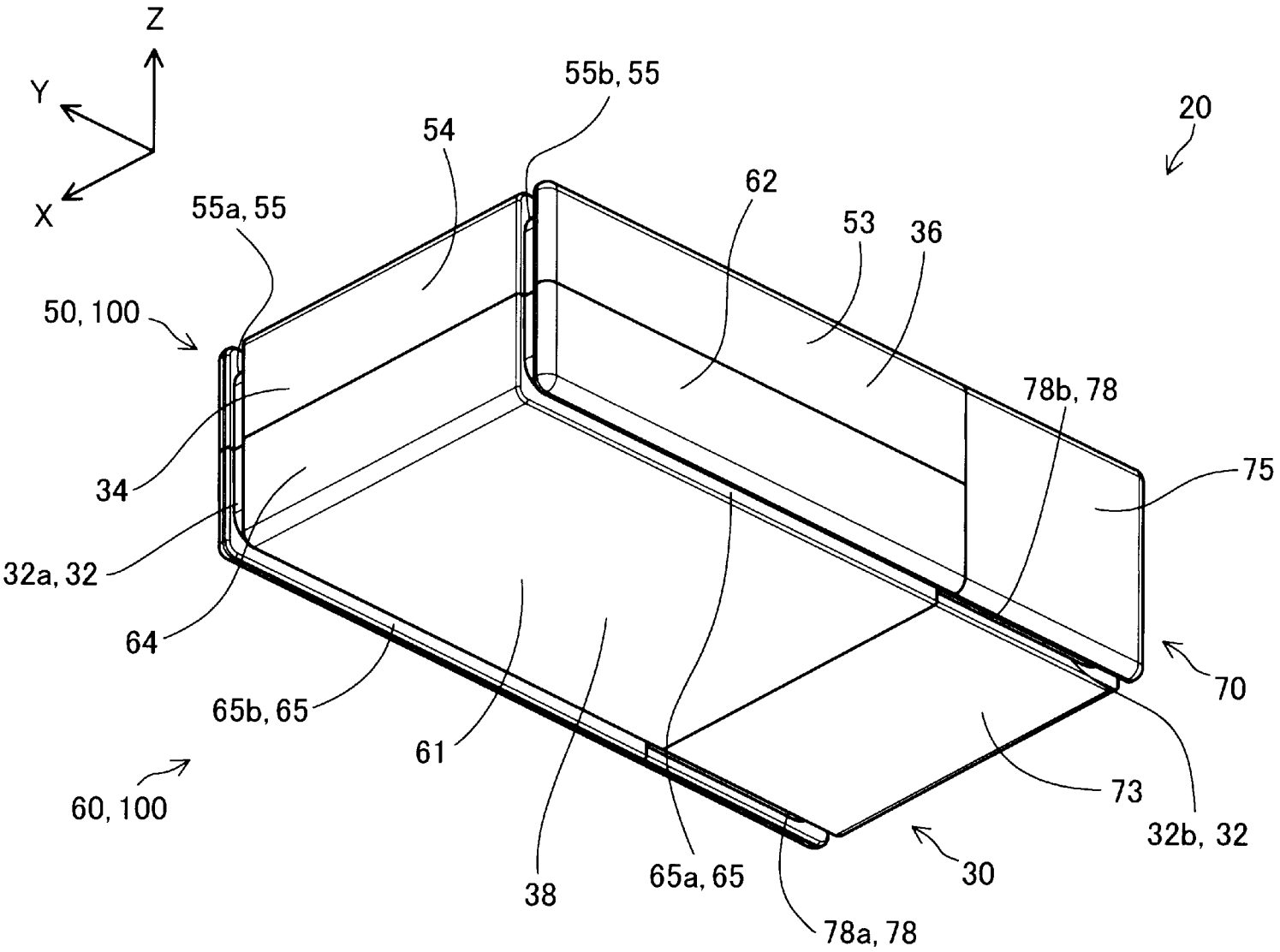
FIG. 2 is a second perspective view of the liquid storage container.

FIG. 1 is a first perspective view of a liquid storage container 20 according to a first embodiment. FIG. 2 is a second perspective view of the liquid storage container 20. FIGS. 1 and 2 show the liquid storage container 20 before a sheet 80 (described below) is attached. The liquid storage container 20 is removably attached to a liquid consuming device. In this embodiment, the liquid consuming device is a printer. The printer is not illustrated. FIG. 1 shows arrows corresponding to the X-axis, Y-axis, and Z-axis directions, which are three directions perpendicular to one another. The X-axis, Y-axis, and Z-axis directions correspond to the width, longitudinal, and height directions of the liquid storage container 20. The liquid storage container 20 is inserted into the printer in the Y-axis direction (attachment direction). The X-axis, Y-axis, and Z-axis directions in other figures correspond to the X-axis, Y-axis, and Z-axis directions in FIG. 1.

As shown in FIGS. 1 and 2, the liquid storage container 20 has a substantially rectangular-parallelepiped-shaped exterior. The liquid storage container 20 includes a housing 30 and a liquid storage portion 40. The housing 30 accommodates the liquid storage portion 40. In FIG. 1, the liquid storage portion 40 is illustrated in a dashed line. The housing 30 is formed by assembling a first case 50, a second case 60, and a lid 70, which can be separated. The longitudinal direction of the housing 30 is parallel to the longitudinal direction of the liquid storage container 20.

In the description below, the wording "two walls intersect each other" means any one of the following states: two walls meet; two walls meet when one wall is extended; and two walls meet when the two walls are extended. Furthermore, the wording "two walls face each other" means either a state in which there is nothing between the two walls or a state in which something is between the two walls.

The first case 50 includes a first wall 51, a first side wall 52, a second side wall 53, and a rear wall 54. The first wall 51, the first side wall 52, the second side wall 53, and the rear wall 54 have a substantially equal thickness. Herein, "walls" do not need to be planar and may have a step, a groove, a bent portion, an inclined surface, a hole, a slit, or the like.

The first side wall 52 and the second side wall 53 are walls parallel to the Y-axis and Z-axis directions. The first side wall 52 and the second side wall 53 meet the ends of the first wall 51 in the width direction of the liquid storage container 20 and face each other in the X-axis direction. The first side wall 52 is located on the positive side of the second side wall 53 in the X-axis direction. The first side wall 52 and the second side wall 53 intersect the first wall 51 and the rear wall 54.

The rear wall 54 is a wall parallel to the X-axis and Z-axis directions. The rear wall 54 intersects the first wall 51, the first side wall 52, and the second side wall 53. The first side wall 52, the second side wall 53, and the rear wall 54 have a substantially equal height. In the first case 50, the side facing the first wall 51 and the side facing the rear wall 54 are open.

The first case 50 has, in exterior faces thereof, first recesses 55*a* and 55*b*. The first recesses 55*a* and 55*b* suppress detachment of the sheet 80 (described below) from the housing 30. The first recesses 55*a* and 55*b* will be collectively called the "first recesses 55" when they do not need to be distinguished from each other. The first recesses 55 are provided in the surface of the first wall 51, as shown in FIG. 1, and in the surface of the rear wall 54, as shown in FIG. 2. The first recesses 55 provided in these surfaces extend linearly. As shown in FIG. 1, the first recesses 55 are continuous from one end to the other end of the first wall 51 in the longitudinal direction of the liquid storage container 20. Furthermore, as shown in FIG. 2, the first recesses 55 are continuous from one end of the rear wall 54, the end adjoining the first wall 51, to the other end, the end facing the first wall 51. The first recesses 55*a* and 55*b* are parallel to each other, and the first recess 55*a* is located on the positive side of the first recess 55*b* in the X-axis direction.

As shown in FIGS. 1 and 2, the second case 60 includes a second wall 61, a first side wall 62, a second side wall 63, and a rear wall 64. The second case 60 has the same shape as the first case 50. The second wall 61 to the rear wall 64 correspond to the first wall 51 to the rear wall 54 of the first case 50, respectively. The second case 60 has two second recesses 65*a* and 65*b* corresponding to the first recesses 55*a* and 55*b* of the first case 50. The second recesses 65*a* and 65*b* will be collectively called the "second recesses 65" when they do not need to be distinguished from each other.

The second recesses 65 have the same function as the first recesses 55. More specifically, the second recesses 65 suppress detachment of the sheet 80 from the housing 30. As shown in FIG. 2, the second recesses 65 are provided in the surfaces of the second wall 61 and the rear wall 64. The second recesses 65 provided in these surfaces extend linearly. The second recesses 65 are continuous from one end to the other end of the second wall 61 in the longitudinal direction of the liquid storage container 20. Furthermore, as shown in FIG. 2, the second recesses 65 are continuous from one end of the rear wall 64, the end adjoining the second wall 61, to the other end, the end facing the second wall 61. The second recesses 65*a* and 65*b* are parallel to each other, and the second recess 65*a* is located on the negative side of the second recess 65*b* in the X-axis direction.

As described above, the first wall 51, the first side wall 52, the second side wall 53, the rear wall 54 of the first case 50, and the second wall 61, the first side wall 62, the second side wall 63, and the rear wall 64 of the second case 60 constitute case exterior faces, which are the exterior faces of the case 100, formed of the first case 50 and the second case 60.

As shown in FIG. 1, the lid 70 closes a case opening 101. The case opening 101 is an opening defined by arranging the first wall 51 of the first case 50 and the second wall 61 of the second case 60 so as to face each other. The lid 70 includes a front wall 71, a lid first wall 72, a lid second wall 73, a lid first side wall 74, and a lid second side wall 75. The front wall 71, the lid first wall 72, the lid second wall 73, the lid first side wall 74, and the lid second side wall 75 constitute lid exterior faces, which are the exterior faces of the lid 70. The front wall 71 to the lid second side wall 75 have a substantially equal thickness. The walls constituting the lid 70 and the walls constituting the first case 50 and the second case 60 have a substantially equal thickness. The front wall 71 has a supply-port hole 76, in which a liquid supply port 41 of the liquid storage portion 40 is located.

The lid first wall 72 and the lid second wall 73 are walls parallel to the X-axis and Y-axis directions. The lid first wall 72 and the lid second wall 73 face each other in the Z-axis direction. The lid first wall 72 is located on the positive side of the lid second wall 73 in the Z-axis direction. The lid first wall 72 and the lid second wall 73 intersect the front wall 71, the lid first side wall 74, and the lid second side wall 75.

The lid first side wall 74 and the lid second side wall 75 are walls parallel to the Y-axis and Z-axis directions. The lid first side wall 74 and the lid second side wall 75 face each other in the X-axis direction. The lid first side wall 74 is located on the positive side of the lid second side wall 75 in the X-axis direction. The lid first side wall 74 and the lid second side wall 75 intersect the front wall 71, the lid first wall 72, and the lid second wall 73. As shown in FIG. 1, the lid 70 has no wall facing the front wall 71 and has a lid opening 77 instead.

The lid 70 has, in the exterior faces thereof, two lid recesses 78*a* and 78*b* that suppress detachment of the sheet 80 from the housing 30. The lid recesses 78*a* and 78*b* will be collectively called the "lid recesses 78" when they do not need to be distinguished from each other. The lid recesses 78 extend linearly. The lid recesses 78 are continuous from one end to the other end of the lid first wall 72 in the longitudinal direction. Furthermore, as shown in FIG. 1, the lid recesses 78 are continuous from one end of the front wall 71, the end adjoining the lid first wall 72, to one end of the lid second wall 73. Furthermore, as shown in FIG. 2, the lid recesses 78 are continuous from one end of the lid second wall 73, the end adjoining the front wall 71, to the other end. The lid recesses 78*a* and 78*b* are parallel to each other, and the lid recess 78*a* is provided on the positive side of the lid recess 78*b* in the X-axis direction. The dimension of the lid recesses 78 in the width direction is substantially the same as the dimension of the first recesses 55 and the second recess 65 in the width direction.

Figure 3:
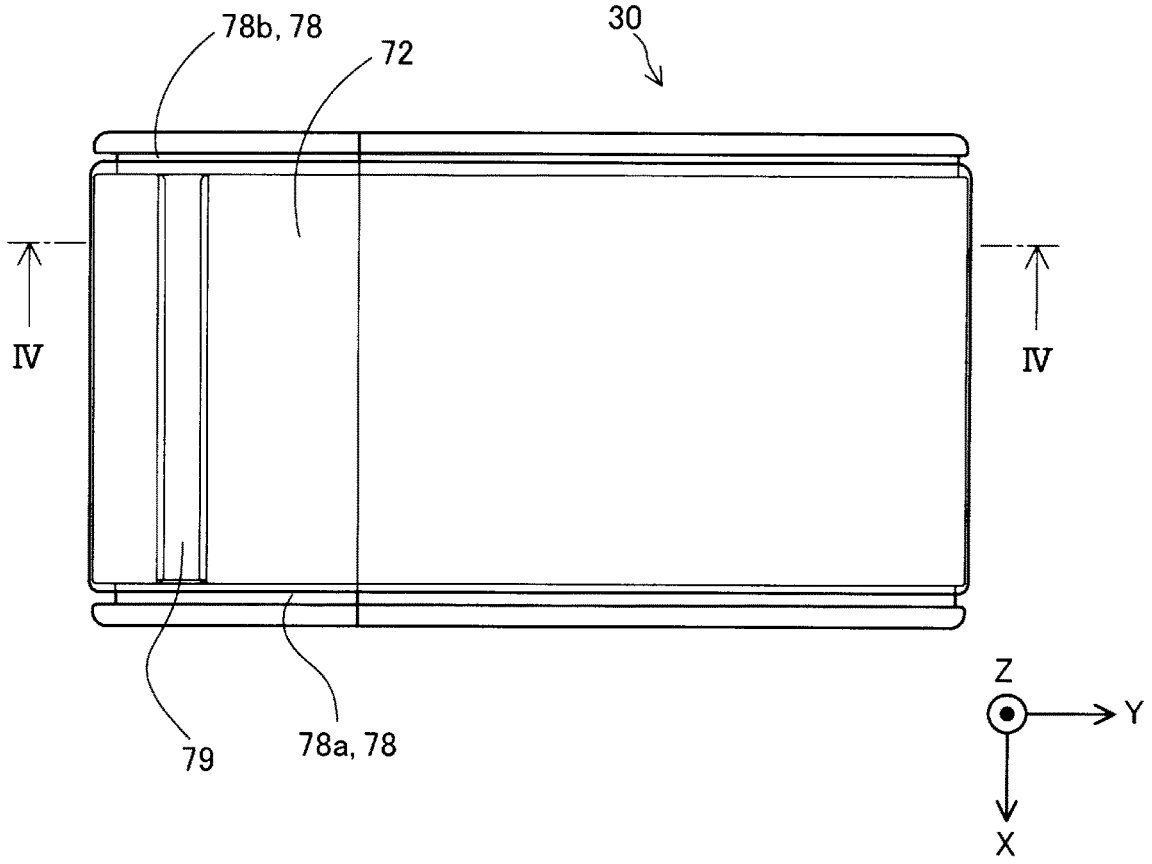
FIG. 3 shows a housing as viewed from the positive side in the Z-axis direction.
Figure 4:
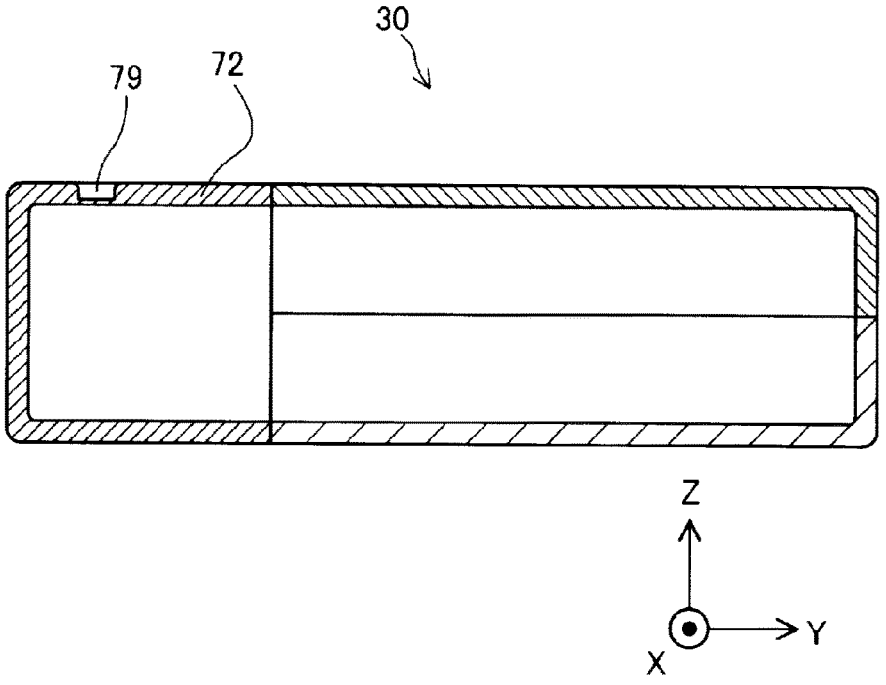
FIG. 4 is a sectional view taken along line IV-IV in FIG. 3.

FIG. 3 shows the housing 30 as viewed from the positive side in the Z-axis direction. FIG. 4 is a sectional view taken along line IV-IV in FIG. 3. As shown in FIGS. 1 and 3, the lid first wall 72 has, on the negative side of the center in the Y-axis direction, a linear welding recess 79 extending in the width direction of the liquid storage container 20. The ends of the welding recess 79 join the lid recesses 78*a* and 78*b*. As shown in FIG. 4, the depth of the welding recess 79, which is the dimension of the welding recess 79 in the Z-axis direction, is smaller than the thickness of the lid first wall 72. The function of the welding recess 79 will be described below.

The liquid storage portion 40 shown in FIG. 1 stores therein the liquid to be supplied to the printer. The liquid storage portion 40 is a flexible bag body that contracts as the liquid therein is consumed and is formed by, for example, four films laminated and joined together at the outer circumferential portions thereof by thermal welding. The liquid supply port 41, through which the liquid inside the liquid storage portion 40 is guided to the outside, is thermally welded to one side of the joined faces of the films.

As described above, the housing 30 is formed by assembling the first case 50, the second case 60, and the lid 70 together. When the housing 30 accommodating the liquid storage portion 40 is formed, first, the first wall 51 of the first case 50 is disposed on the second wall 61 of the second case 60 so as to leave an inner space accommodating the liquid storage portion 40 therebetween. The liquid storage portion 40 is accommodated in the inner space defined by the first case 50 and the second case 60 through the thus-formed case opening 101. Then, by disposing the lid 70 on the first case 50 and the second case 60 so as to close the case opening 101, the liquid storage container 20 accommodating the liquid storage portion 40 is formed.

As shown in FIG. 1, in the housing 30, a surface defined by the front wall 71 of the lid 70 is a first face 33 of the housing 30. As described above, the first face 33, which is the exterior face of the front wall 71, has the supply-port hole 76, in which the liquid supply port 41 is located. As shown in FIG. 2, in the housing 30, a surface defined by the rear wall 54 of the first case 50 and the rear wall 64 of the second case 60 and facing the first face 33 in the Y-axis direction is a second face 34. The liquid storage container 20 is attached to the printer from the first face 33 side.

As shown in FIG. 1, a surface defined by the lid first side wall 74 of the lid 70, the first side wall 52 of the first case 50, and the second side wall 63 of the second case 60 is a first side face 35. As shown in FIG. 2, a surface defined by the lid second side wall 75 of the lid 70, the second side wall 53 of the first case 50, and the first side wall 62 of the second case 60 and facing the first side face 35 in the X-axis direction is a second side face 36. As shown in FIG. 1, a surface defined by the lid first wall 72 of the lid 70 and the first wall 51 of the first case 50 is a third side face 37. As shown in FIG. 2, a surface defined by the lid second wall 73 of the lid 70 and the second wall 61 of the second case 60 and facing the third side face 37 in the Z-axis direction is a fourth side face 38. The first side face 35 to the fourth side face 38 connect the first face 33 and the second face 34.

As shown in FIGS. 1 and 2, in the thus-formed housing 30, the recesses are continuous with one another. More specifically, the ends of the first recess 55*a* in the first case 50 join the lid recess 78*a* in the lid 70 and the second recess 65*b* in the second case 60. The end of the lid recess 78*a* opposite to the end joining the first recess 55*a* joins the end of the second recess 65*b* opposite to the end joining the first recess 55*a*. The wording "join" as used herein means a state in which the ends of the recesses are physically in contact with each other.

This way, a housing recess 32*a* extending around the outer circumference of the housing 30 is formed in the exterior faces of the housing 30. Similarly, the first recess 55*b*, the second recess 65*a*, and the lid recess 78*b* join one another, forming a housing recess 32*b*. The housing recesses 32*a* and 32*b* will be collectively called the "housing recesses 32" when they do not need to be distinguished from each other. The housing recesses 32 suppress detachment of the sheet 80 from the housing 30.

Figure 5:
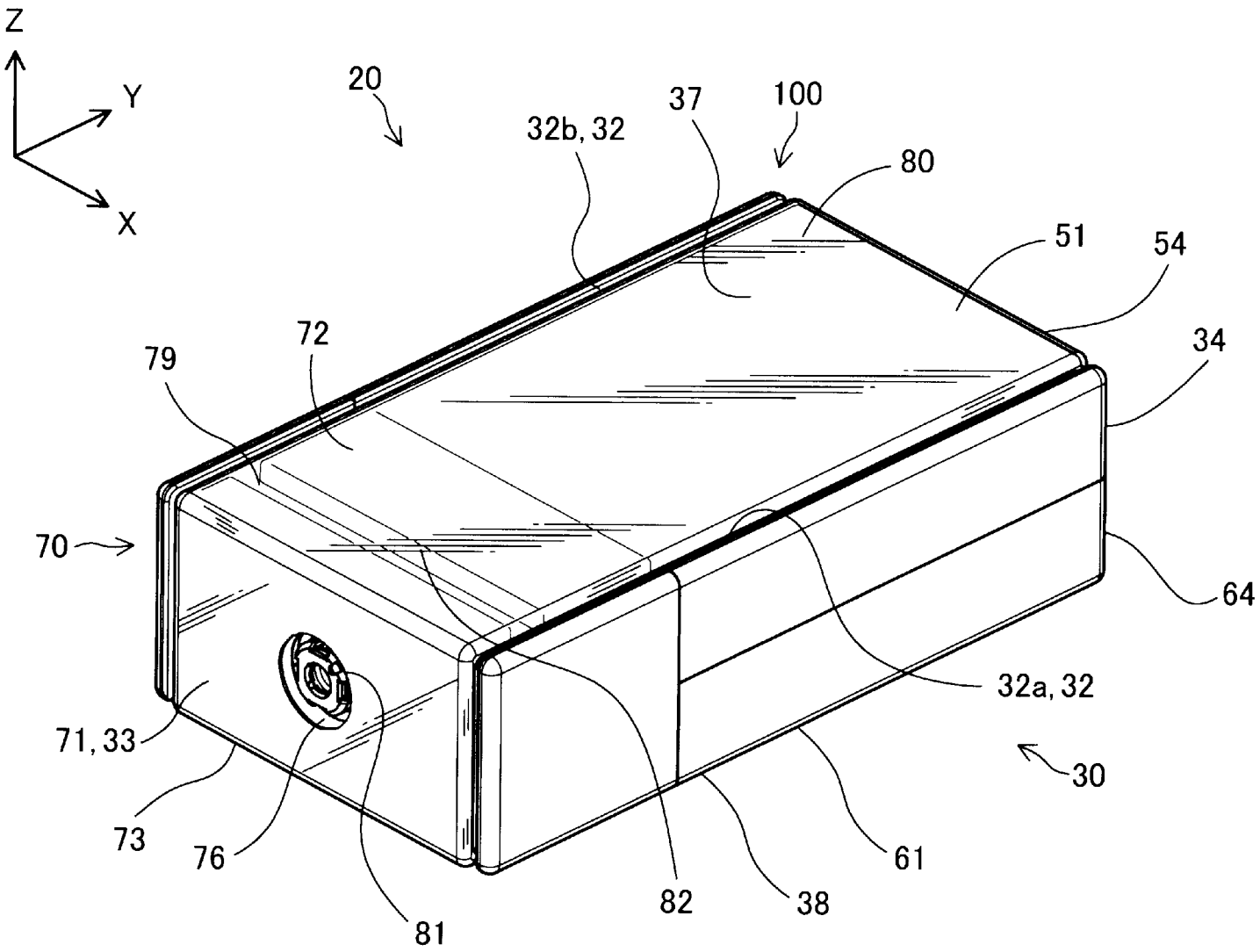
FIG. 5 is a schematic perspective view of the liquid storage container.
Figure 6:
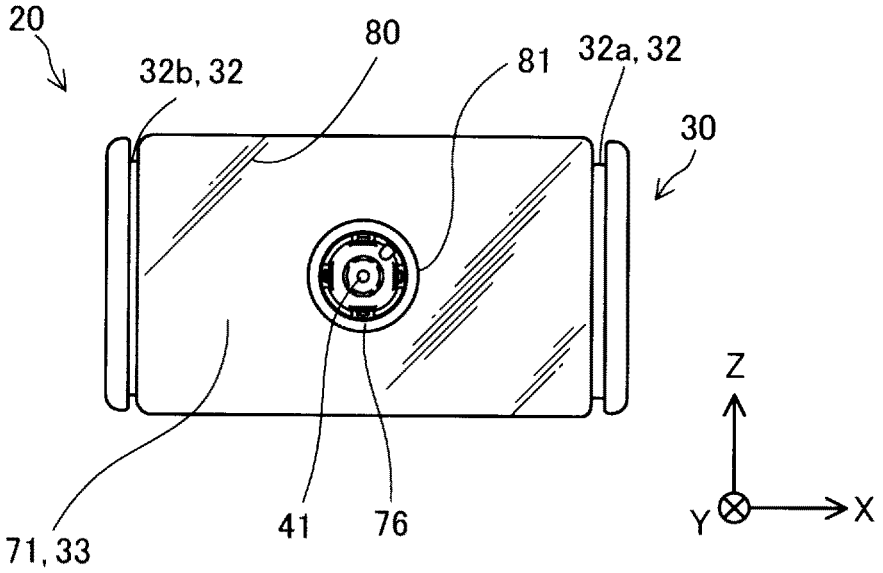
FIG. 6 shows the liquid storage container as viewed from the negative side in the Y-axis direction.
Figure 7:
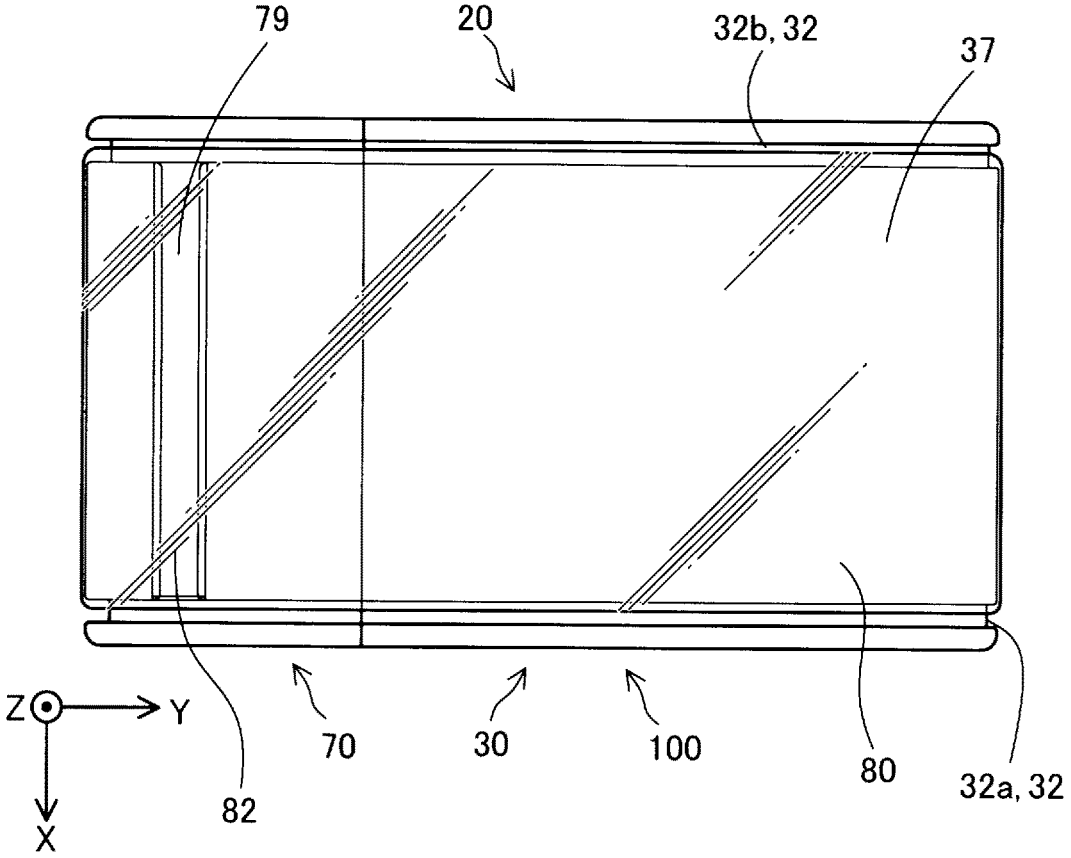
FIG. 7 shows the liquid storage container as viewed from the positive side in the Z-axis direction.
Figure 8:
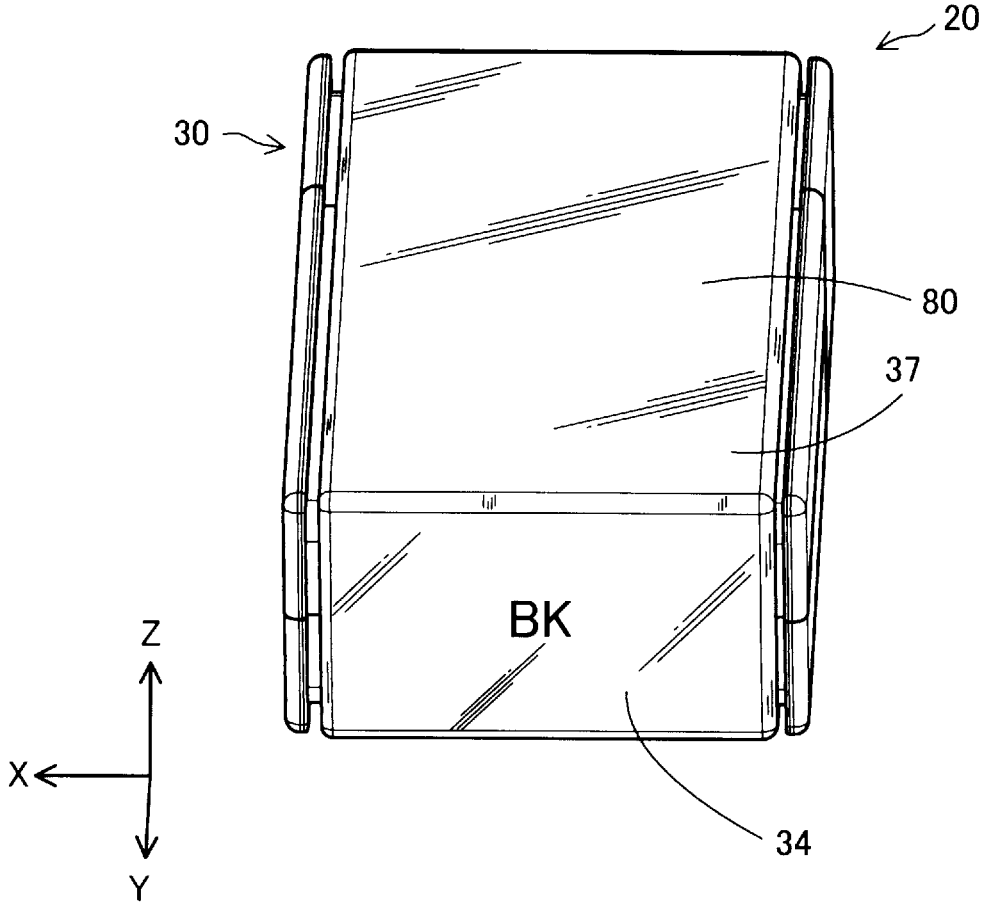
FIG. 8 shows an external perspective view of the liquid storage container.

FIG. 5 is a schematic perspective view of the liquid storage container 20. For ease of understanding, FIG. 5 (as well as FIGS. 7, 11 and 12) shows the exterior faces of the housing 30 through the sheet 80. FIG. 6 shows the liquid storage container 20, as viewed from the negative side in the Y-axis direction. FIG. 7 shows the liquid storage container 20, as viewed from the positive side in the Z-axis direction. FIG. 8 is an external perspective view of the liquid storage container 20.

As shown in FIGS. 5 to 8, in the liquid storage container 20, the sheet 80 is disposed on the exterior faces of the housing 30 so as to surround the outer circumference of the housing 30. More specifically, the sheet 80 is disposed so as to surround the outer circumference of the housing 30, around the X-axis direction, which corresponds to the width direction of the liquid storage container 20. More specifically, the sheet 80 extends over the front wall 71, the lid first wall 72, and the lid second wall 73, which constitute the lid exterior faces, and the first wall 51, the rear wall 54, the second wall 61, and the rear wall 64, which constitute the case exterior faces, and holds the lid 70 and the case 100 together so as not to be separated.

The sheet 80 has a substantially rectangular shape and has a length in the longitudinal direction that is enough to surround the outer circumference of the housing 30 in the longitudinal direction. The width of the sheet 80 is smaller than the width of the housing 30. More specifically, the width of the sheet 80 is substantially the same as the distance between the housing recess 32*a* and the housing recess 32*b*. The sheet 80 is made of a synthetic resin, such as polyethylene. The sheet 80 has a sheet hole 81, which has substantially the same diameter as the supply-port hole 76.

The sheet 80 is disposed on the housing 30 as described below. The sheet 80 is wound around the outer circumference of the housing 30 such that the sheet hole 81 and the supply-port hole 76 are aligned. More specifically, the sheet 80 is disposed on the housing 30 so as to extend over the first face 33, the third side face 37, the second face 34, and the fourth side face 38 of the housing 30 and so as to cover the welding recess 79 with the ends thereof overlapping each other.

Then, one of two welding tools (not shown) is inserted between the welding recess 79, shown in FIG. 5, and the ends of the sheet 80, and the other welding tool is applied thereto so as to nip the ends of the sheet 80 therebetween to thermally welding the ends of the sheet 80 together. The portion of the sheet 80 joined at the welding recess 79 is called a welded portion 82.

As described above, the housing 30 is formed not by fitting but by assembling the first case 50, the second case 60, and the lid 70 together in a nested manner. Hence, although the housing 30 alone is easily disassembled, by welding the ends of the sheet 80 wound around the housing 30, the shape of the housing 30 is maintained by the sheet 80.

Furthermore, because the ends of the sheet 80 are joined together, the shape of the housing 30 is maintained without needing to bond the sheet 80 to the housing 30. This reduces inconvenience caused when the sheet 80 is bonded to the housing 30. For example, because the housing 30 and the sheet 80 are easily separated from each other in the process of recycling, damage to the housing 30 is prevented. This improves the recycling rate of the housing 30. The recycling rates of the first case 50, the second case 60, and the lid 70 also improve. Furthermore, for example, even when the liquid storage container 20 is subjected to a high-temperature environment, because the sheet 80 is not directly bonded to the housing 30, the sheet 80 can be easily separated from the housing 30. As a result, the working efficiency in disassembling the liquid storage container 20 improves.

Furthermore, the ends of the sheet 80 are thermally welded together by inserting the welding tool into the welding recess 79. Hence, the sheet 80 can be easily disposed on the housing 30.

As described above, the housing 30 has, in the exterior faces thereof, the housing recesses 32 extending in the longitudinal direction. Hence, even when the sheet 80 slides in the width direction of the housing 30, an end of the sheet 80 is caught by either the housing recess 32*a* or the housing recess 32*b* and is prevented from sliding any further. Because detachment of the sheet 80 from the housing 30 is suppressed, unintentional disassembly of the liquid storage container 20 is prevented.

The liquid storage container 20 is attached to a printer as described below. The liquid storage container 20 is attached to the printer so as to be moved toward the negative side in the Y-axis direction such that the first face 33 of the housing 30 faces the printer. The liquid storage container 20 attached to the printer is used in a state in which the exterior faces thereof except for the second face 34 are accommodated in the printer. As shown in FIG. 8, in the liquid storage container 20 according to this embodiment, because the sheet 80 is disposed on the second face 34, information about the liquid storage container 20 can be indicated on a portion of the sheet 80 located on the second face 34. Hence, when a user uses the liquid storage container 20, the user can easily check the information about the liquid storage container 20. Examples of the information about the liquid storage container 20 include the color of the liquid stored therein.

The welding recess 79 also functions as a cutting recess at which the sheet 80 can be cut. By cutting the sheet 80 along the welding recess 79 with a tool, such as a cutter knife, in recycling the liquid storage container 20, the sheet 80 can be easily separated from the liquid storage container 20. Hence, the recycling rates of the case 100 and the lid 70 further improve.

B. Configuration in Second Embodiment

Figure 9:
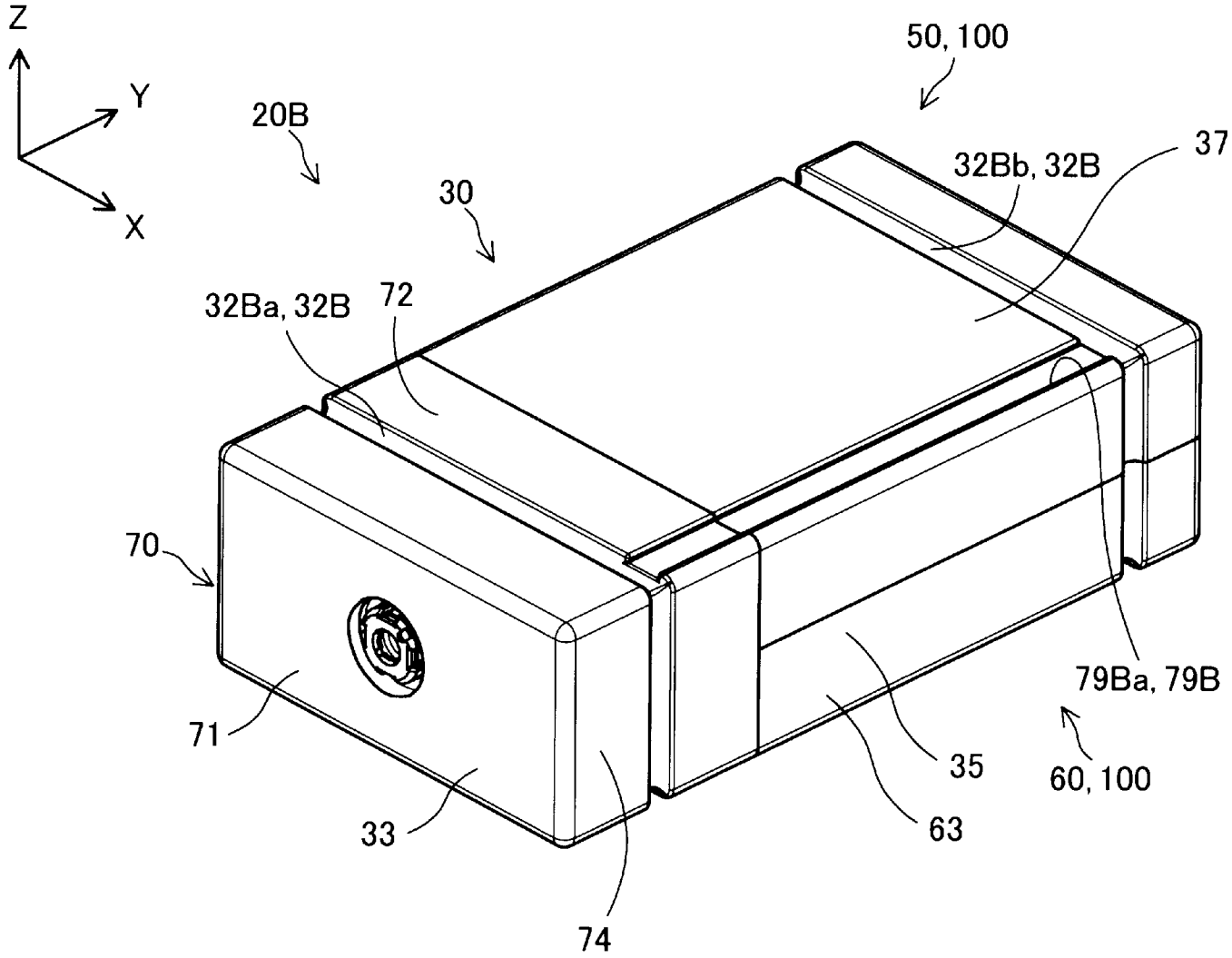
FIG. 9 is a first perspective view of a liquid storage container according to a second embodiment.
Figure 10:
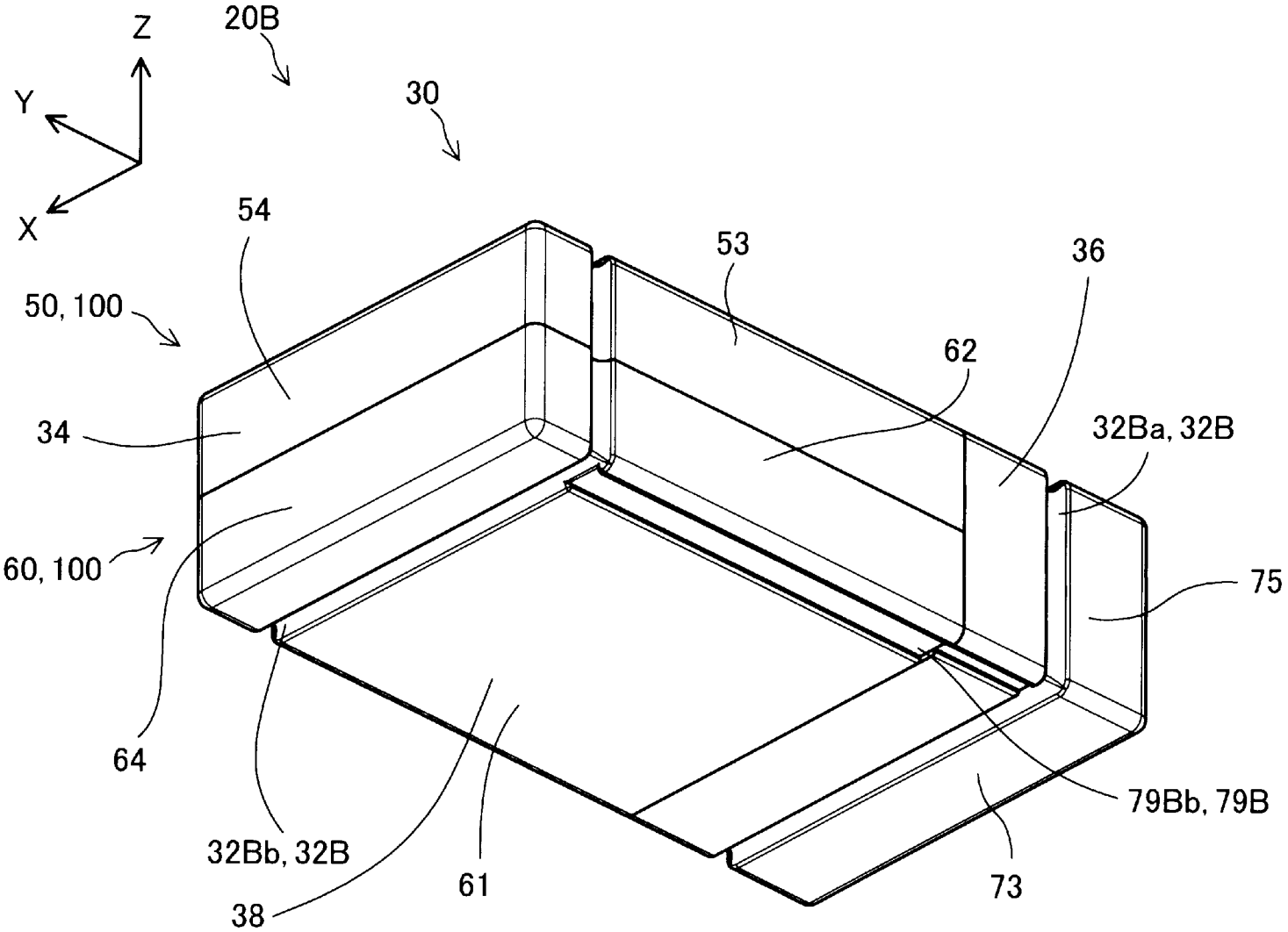
FIG. 10 is a second perspective view of the liquid storage container according to the second embodiment.

FIG. 9 is a first perspective view of a liquid storage container 20B according to a second embodiment. FIG. 10 is a second perspective view of the liquid storage container 20B. FIGS. 9 and 10 show the liquid storage container 20B before the sheet 80 (described below) is attached. The basic structure in the second embodiment, in which the sheet 80 is wound around the outer circumference of the housing 30, is the same as that in the first embodiment. The second embodiment differs from the first embodiment in the positions where housing recesses 32B and welding recesses 79B are formed, and the direction in which the sheet 80 is wound around the housing 30. The same components as those according to the first embodiment will be denoted by the same reference signs, and the descriptions thereof will be omitted. The sheet 80 according to the second embodiment has no hole that is provided in the sheet 80 according to the first embodiment.

In the second embodiment, similarly to the first embodiment, the housing 30 is formed by assembling the first case 50, the second case 60, and the lid 70 in a nested manner.

Housing recesses 32Ba and 32Bb suppress detachment of the sheet 80 from the housing 30. The housing recess 32Ba is provided in the exterior faces of the lid 70. The housing recess 32Ba is formed so as to surround the outer circumference of the lid 70, around the Y-axis direction, which corresponds to the longitudinal direction of the liquid storage container 20. The housing recess 32Bb is provided in the exterior faces of the case 100. The housing recess 32Bb is formed so as to surround the outer circumference of the case 100, around the Y-axis direction, which corresponds to the longitudinal direction of the liquid storage container 20. The housing recesses 32Ba and 32Bb will be collectively denoted by reference sign 32B when they do not need to be distinguished from each other.

Welding recesses 79Ba and 79Bb extend linearly in the Y-axis direction, which corresponds to the longitudinal direction of the housing 30. As shown in FIG. 9, the welding recess 79Ba is provided in the third side face 37. As shown in FIG. 10, the welding recess 79Bb is provided in the fourth side face 38. Note that one of the welding recesses 79Ba and 79Bb may be omitted. The welding recesses 79Ba and 79Bb will be collectively denoted by reference sign 79B when they do not need to be distinguished from each other. The welding recesses 79B extend between the two housing recesses 32Ba and 32Bb, which are formed at a distance from each other in the longitudinal direction of the housing 30. More specifically, the welding recesses 79B join at one end to the housing recess 32Ba and at the other end to the housing recess 32Bb. The welding recesses 79Ba and 79Bb also serve as cutting recesses at which the sheet 80 can be cut.

Figure 11:
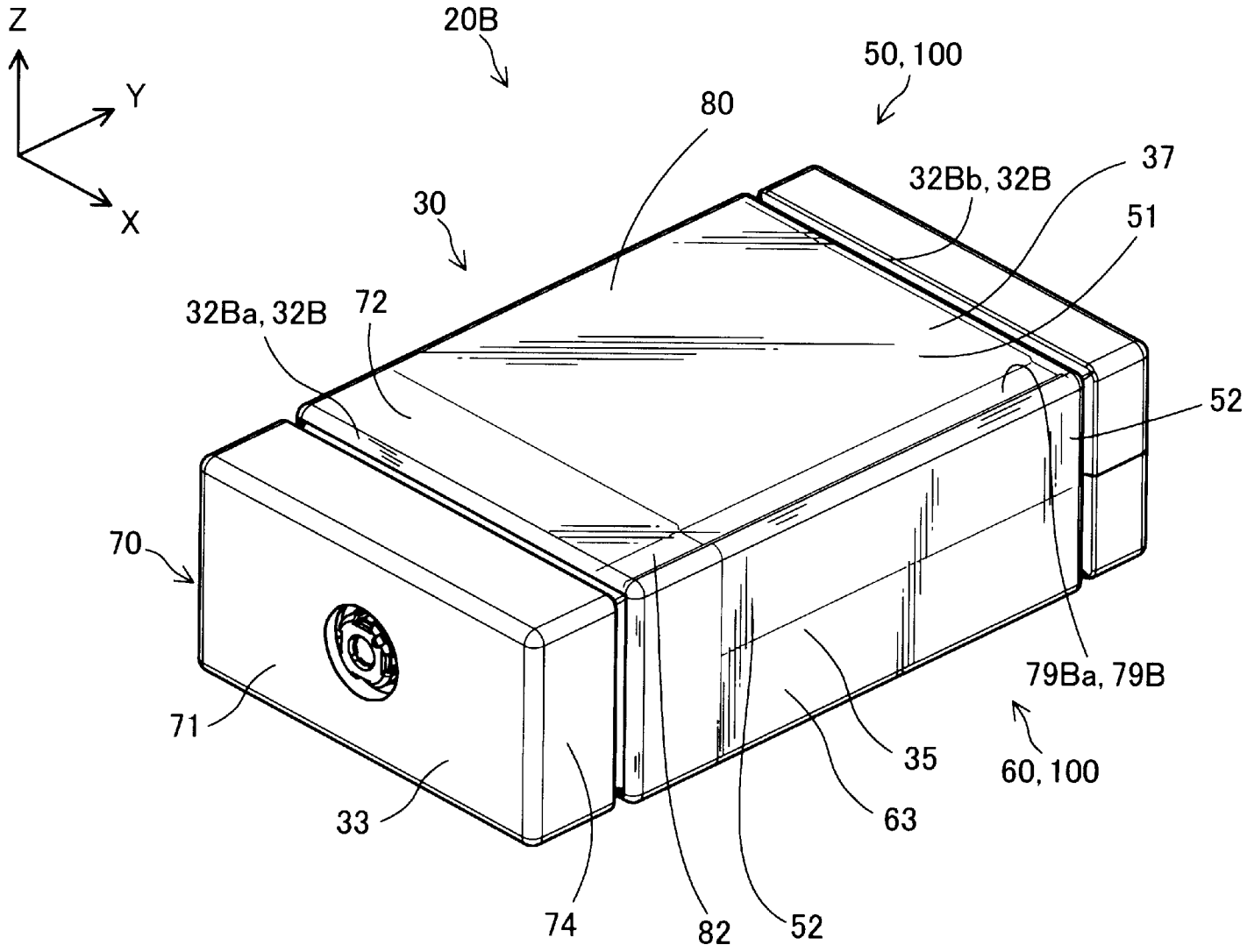
FIG. 11 is a first schematic perspective view of the liquid storage container according to the second embodiment.
Figure 12:
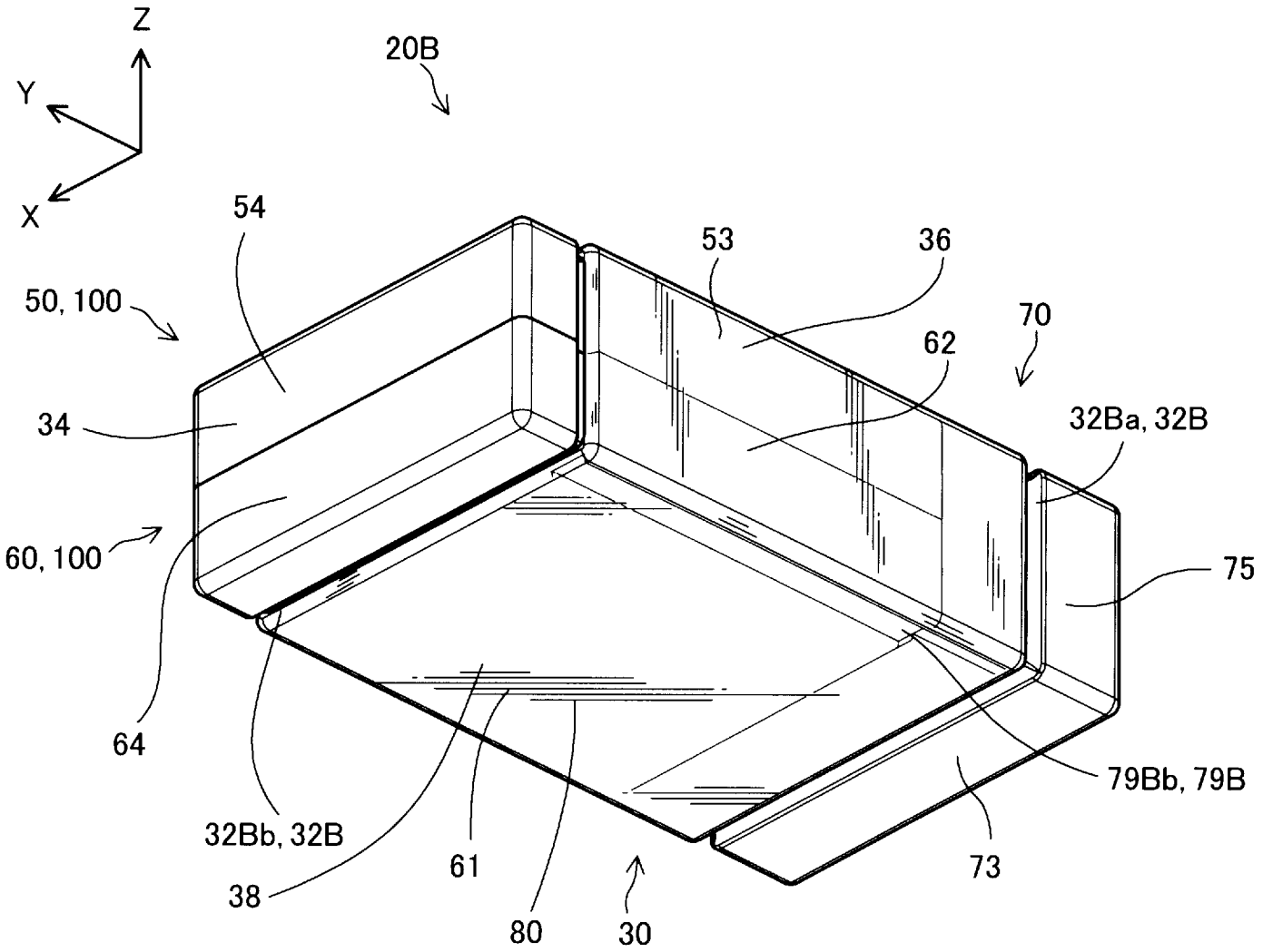
FIG. 12 is a second schematic perspective view of the liquid storage container according to the second embodiment.

FIG. 11 is a first schematic perspective view of the liquid storage container 20B according to the second embodiment. FIG. 12 is a second schematic perspective view of the liquid storage container 20B according to the second embodiment. Because the method of producing the housing 30 accommodating the liquid storage portion 40 is the same as that in the first embodiment, the method will not be described again here. The sheet 80 extends over portions of the lid first wall 72, the lid second wall 73, the lid first side wall 74, and the lid second side wall 75, which constitute the lid exterior faces, and portions of the first wall 51, the first side wall 52, and the second side wall 53 of the first case 50, the second wall 61, the first side wall 62, and the second side wall 63 of the second case 60, which constitute the case exterior faces, to hold the lid 70 and the case 100 together so as not to be separated. In other words, the sheet 80 is disposed so as to surround the outer circumference of the housing 30, around the Y-axis direction, which corresponds to the longitudinal direction of the liquid storage container 20B. As in the first embodiment, the sheet 80 is not directly bonded to the housing 30, but the ends of the sheet 80 are welded together. The sheet 80 extends over the lid exterior faces of the lid 70 and the case exterior faces of the case 100.

The sheet 80 is disposed on the housing 30 such that the ends of the sheet 80 overlapping each other cover the welding recess 79Ba. Then, the ends of the sheet 80 are thermally welded together, forming the welded portion 82. As a result, the sheet 80 is fixed on the housing 30. The method of thermal welding of the sheet 80 is the same as that in the first embodiment. The ends of the sheet 80 may be disposed so as to cover the welding recess 79Bb in the housing 30.

Through this process, the sheet 80 can be disposed so as to surround the side faces of the housing 30 without being bonded to the housing 30. Because the housing 30 can be held with the sheet 80 as in the first embodiment, the recycling rates of the first case 50, the second case 60, and the lid 70 improve. Furthermore, even when the liquid storage container 20B is subjected to a high-temperature environment, because the sheet 80 is not directly bonded to the housing 30, the sheet 80 can be easily removed from the housing 30. Hence, the working efficiency in disassembling the liquid storage container 20B improves.

The welding recesses 79B also function as cutting recesses, at which the sheet 80 can be cut. By cutting the sheet 80 along the welding recesses 79B with a tool, such as a cutter knife, in recycling the liquid storage container 20B, the sheet 80 can be easily separated from the liquid storage container 20. Hence, the recycling rates of the case 100 and the lid 70 further improve.

C. Other Embodiments (C1) In the above-described embodiments, the first case 50 and the second case 60 are separate members. However, the first case and the second case may be formed as a single member.

(C2) In the above-described embodiments, the housing recesses 32 and 32B that suppress detachment of the sheet 80 from the housing 30 are formed in the exterior faces of the first case 50, the second case 60, and the lid 70. However, for example, the recesses may be formed only in the lid, and the recesses may be continuous only in the upper wall, the first side wall, and the second side wall of the lid. The shape of the recesses does not need to be linear, but may be a wave shape or a circular shape, and the width thereof does not need to be uniform. Furthermore, projections may be formed instead of the recesses, or both a recess and a projection may be formed.

(C3) In the above-described embodiments, the cutting recess at which the sheet 80 can be cut and the welding recess at which the welded portion 82 can be formed are the same element and are formed at the same portion. However, the welding recess and the cutting recess may be provided at different positions. The cutting recess may be provided in the lid, and the welding recess may be provided in the case. The widths of the recesses do not need to be equal. It is preferable that the ends of the sheet can be joined together at the welding recess and that the sheet can be cut at the cutting recess to separate the sheet and the housing.

(C4) In the above-described embodiments, the sheet 80 is made of polyethylene. However, the sheet 80 may be made of, for example, polypropylene, paper, or the like. The sheet may be transparent. The method of joining is not limited to thermal welding, and the sheet 80 may be attached to the housing by, for example, causing the sheet to shrink by heat after the sheet is wound around the housing. Furthermore, other joining measures, such as adhesive and double-faced tape, can also be used.

(C5) In the above-described embodiments, the ends of the sheet 80 are welded together by using two welding tools. However, for example, the ends of the sheet may be pinched by a pinch-type welding tool and welded together.

(C6) In the above-described embodiments, the liquid consuming device has been described as a printer. However, for example, the liquid consuming device may be applied to an apparatus other than the printer, such as a facsimile machine and a colorant ejecting apparatus that is used to produce a color filter for an image display apparatus, such as a liquid crystal display apparatus.

(C7) In the above-described embodiments, the liquid storage container 20 attached to the printer is used in a state in which the exterior faces thereof except for the second face 34 are accommodated in the printer. However, for example, the liquid storage container may be used in a state in which the exterior faces thereof except for the second face, portions of the first, second, third, and fourth side faces are accommodated in the printer.

D. Other Aspects

The present disclosure is not limited to the above-described embodiments, but may be implemented in the forms of various aspects within the scope not departing from the spirit thereof. For example, the present disclosure may be implemented in the forms of the following aspects. The technical features in the above-described embodiments corresponding to the technical features in the aspects described below can be switched or combined, where appropriate, to solve some or all of the problems of the present disclosure or to achieve some or all of the advantages of the present disclosure. Furthermore, the technical features that are not described as essential in this disclosure may be omitted, where appropriate.

(1) According to an aspect of the present disclosure, a liquid storage container is provided. The liquid storage container includes: a housing including a case having a case opening, and a lid that closes the case opening; and a sheet that holds the lid and the case together, the sheet extending over lid exterior faces and case exterior faces and being disposed so as to surround the outer circumference of the housing. In this aspect, the case and the lid can be held together without needing to bond the sheet to the case and the lid. This reduces inconvenience caused when the sheet is bonded to the case and the lid. For example, because the case and the lid can be easily separated from the sheet in the process of recycling, damage to the case and the lid is prevented. This improves the recycling rates of the case and the lid. Furthermore, for example, even when the liquid storage container is subjected to a high-temperature environment, because the sheet can be easily separated from the case and the lid, the working efficiency in disassembling the liquid storage container improves.

(2) In the liquid storage container according to the above-described aspect, at least one of the lid exterior faces and the case exterior faces may have at least one of a recess and a projection that suppresses detachment of the sheet from the housing. In this aspect, detachment of the sheet from the housing is suppressed. Hence, it is possible to prevent unintentional disassembly of the liquid storage container.

(3) In the liquid storage container according to the above-described aspect, at least one of the lid exterior faces and the case exterior faces may have a cutting recess at which the sheet can be cut, and the sheet may cover the cutting recess. In this aspect, by cutting a sheet portion covering the cutting recess in recycling the liquid storage container, the sheet can be easily separated from the liquid storage container. Hence, the recycling rates of the case and the lid further improve.

(4) In the liquid storage container according to the above-described aspect, the sheet may have a welded portion where portions of the sheet overlap each other and are welded together, at least one of the lid exterior faces and the case exterior faces may have a welding recess at which the welded portion can be formed, and the sheet may cover the welding recess. In this aspect, by inserting a welding tool into the welding recess, portions of the sheet can be welded together between the welding tool and another welding tool. Hence, the sheet can be easily disposed on the housing.

(5) The liquid storage container according to the above-described aspect may further include a liquid storage portion that stores liquid, the liquid storage portion having a liquid supply port. The housing may have a first face having a supply-port hole, in which the liquid supply port is disposed, a second face facing the first face, and side faces connecting the first face and the second face and constituting the case and the lid. The sheet may be disposed so as to surround the outer circumference of the side faces. In this aspect, the sheet can be disposed so as to surround the side faces of the housing.

(6) The liquid storage container according to the above-described aspect may further include a liquid storage portion that stores liquid, the liquid storage portion having a liquid supply port. The housing may have a first face having a supply-port hole, in which the liquid supply port is disposed, a second face facing the first face, and side faces connecting the first face and the second face and constituting the case and the lid. The sheet may extend over the first face, the second face, and portions of the side faces. In this aspect, information about the liquid storage container can be indicated on a sheet portion on the second face, which faces the first face having the supply-port hole. This allows a user to easily check the information about the liquid storage container when using the liquid storage container.

What is claimed is:

1. A liquid storage container comprising:

a housing including a case having a case opening, and a lid that closes the case opening; and a sheet that holds the lid and the case together, the sheet extending over lid exterior faces and case exterior faces and being disposed so as to surround an outer circumference of the housing, wherein the sheet has a welded portion where portions of the sheet overlap each other and are welded together, at least one of the lid exterior faces and the case exterior faces has a welding recess at which the welded portion is formed, and the sheet covers the welding recess.

2. The liquid storage container according to claim 1, wherein at least one of the lid exterior faces and the case exterior faces has at least one of a recess and a projection that suppresses detachment of the sheet from the housing.

3. The liquid storage container according to claim 1, wherein at least one of the lid exterior faces and the case exterior faces has a cutting recess at which the sheet is cut, and the sheet covers the cutting recess.

4. The liquid storage container according to claim 1, further comprising a liquid storage portion that stores liquid, the liquid storage portion having a liquid supply port, wherein the housing has a first face having a supply-port hole, in which the liquid supply port is disposed, a second face facing the first face, and side faces connecting the first face and the second face and constituting the case and the lid, and the sheet is disposed so as to surround the outer circumference of the side faces.

5. The liquid storage container according to claim 1, further comprising a liquid storage portion that stores liquid, the liquid storage portion having a liquid supply port, wherein the housing has a first face having a supply-port hole, in which the liquid supply port is disposed, a second face facing the first face, and side faces connecting the first face and the second face and constituting the case and the lid, and the sheet extends over the first face, the second face, and portions of the side faces.

* * * * *